US007913619B2

(12) United States Patent
Hogl et al.

(10) Patent No.: US 7,913,619 B2
(45) Date of Patent: Mar. 29, 2011

(54) EMBOSSING APPARATUS

(75) Inventors: Helmut Hogl, Nuremberg (DE); Norbert Hofler, Oberscheinfeld (DE)

(73) Assignee: Leonhard Kurz Stiftung & Co. KG, Furth (DE)

( * ) Notice: Subject to any disclaimer, the term of this patent is extended or adjusted under 35 U.S.C. 154(b) by 605 days.

(21) Appl. No.: 11/986,868

(22) Filed: Nov. 27, 2007

(65) Prior Publication Data

US 2008/0173192 A1 Jul. 24, 2008

(30) Foreign Application Priority Data

Nov. 30, 2006 (DE) ..... 10 2006 056 701

(51) Int. Cl.
*B41F 19/02* (2006.01)

(52) U.S. Cl. ..... 101/27; 101/9; 101/31

(58) Field of Classification Search ..... 101/8, 9, 101/10, 21, 23, 27, 31
See application file for complete search history.

(56) References Cited

U.S. PATENT DOCUMENTS

| | | | | | |
|---|---|---|---|---|---|
| 2,961,950 | A | * | 11/1960 | Kingsley | 101/381 |
| 2,996,000 | A | * | 8/1961 | Kingsley | 101/11 |
| 3,483,063 | A | * | 12/1969 | Baines et al. | 156/517 |
| 3,975,226 | A | * | 8/1976 | Boettcher | 156/358 |
| 4,175,993 | A | * | 11/1979 | Robertson | 156/234 |
| 4,327,635 | A | * | 5/1982 | Kelly et al. | 101/18 |
| 4,453,468 | A | * | 6/1984 | Shenoha | 101/389.1 |
| 5,115,737 | A | | 5/1992 | Amendola | |
| 2006/0108071 | A1 | | 5/2006 | Mitsam | |

FOREIGN PATENT DOCUMENTS

| | | | |
|---|---|---|---|
| DE | 1161568 | | 1/1964 |
| DE | 3531898 | | 3/1986 |
| DE | 3855784 | T2 | 10/1988 |
| DE | 19539410 | | 4/1996 |
| DE | 29620889 | U1 | 4/1997 |
| DE | 10037643 | A1 | 2/2002 |
| DE | 10216139 | C1 | 11/2003 |
| DE | 202004003746 | | 5/2004 |
| EP | 0437720 | | 7/1991 |
| EP | 0453168 | | 10/1991 |
| EP | 0339079 | B1 | 2/1997 |
| WO | WO 89/03760 | | 5/1989 |
| WO | WO 2005/047019 | | 5/2005 |
| WO | WO 2005/095122 | | 10/2005 |

* cited by examiner

*Primary Examiner* — Ren Yan
(74) *Attorney, Agent, or Firm* — Hoffmann & Baron, LLP

(57) ABSTRACT

There is described an apparatus for embossing a decorative layer of an embossing film (12) which is of a strip form, on to a small-radiused corner of a surface element, wherein a high cycle speed and high cycle rates are achieved in that the embossing apparatus (10) has a revolver head (16) which is rotatable stepwise about an axis (18) and which at its periphery (26) has a number of elastic pressing members (28) with which a heating device (30) is associated, wherein the revolver head (16) is reciprocatingly movable on a linear drive device (20) between an embossing position and an inactive position.

20 Claims, 3 Drawing Sheets

EMBOSSING APPARATUS

This application claims priority based on German Application No. 102006056701.3-14, filed on Nov. 30, 2006.

BACKGROUND OF THE INVENTION

The invention concerns an apparatus for embossing a decorative layer of an embossing film which is of a strip form, on to a small-radiused corner of a surface element.

An apparatus for embossing a decorative layer of an embossing film which is of a strip form on to the narrow sides, which delimit a surface element, of the surface element is known for example from DE 102 16 139 C1. With that known embossing apparatus it is possible for surface elements to be embossed at their narrow sides with the decorative layer of an embossing film which is of a strip form, at high cycle speeds, that is to say high cycle rates. If however the respective surface element has rounded configurations of a small radius at its corners, then the corresponding decorative layer portions at those corners have hitherto been fixed to the rounded corners for example by means of a tool which is to be operated manually. That manual mode of operation is however only possible at low cycle speeds or cycle rates so that the productivity correspondingly leaves something to be desired. The rounded configurations can for example involve a radius of between 2 mm and 5 mm, in which respect it will be appreciated that the corresponding problems also arise in relation to radii of different sizes.

For embossing rounded corners of surface elements, it is for example also possible to use a stroke embossing procedure as can be carried out for example with an embossing machine of the PE500/KTF 'Touchwood' type. However corners of a surface element, which involve a small radius, can only be embossed at moderate cycle speeds, when using an embossing machine of that kind.

Likewise it is possible for pin elements comprising a plastic material to be rolled in peripheral relationship against the surface element to be embossed, in which case the surface element to be embossed and the pin elements perform a relative movement with respect to each other during the decoration procedure. Higher embossing speeds can admittedly be achieved, in comparison with a stroke embossing procedure, when using such a known double embossing head; however, that higher speed still leaves something to be desired in comparison with an embossing apparatus in accordance with above-mentioned DE 102 16 139 C1, for embossing narrow sides of surface elements. That results for example from the insulating properties of the plastic pins of the double embossing head as the heat has to be transported from the interior of the punch or pressing member to the surface thereof, which requires a relatively large amount of time. The through-put of surface elements to be embossed, per unit of time, is correspondingly low.

SUMMARY OF THE INVENTION

In consideration of those factors the object of the invention is to provide an embossing apparatus of the kind set forth in the opening part of this specification, with which it is possible, at a high level of productivity, that is to say with a high embossing speed and with high cycle rates, to emboss small-radiused corners of a surface element with a decorative layer of an embossing film in strip form.

In an apparatus of the kind set forth in the opening part of this specification, in accordance with the invention that object is attained by a revolver head which is rotatable stepwise about an axis and which is provided at a linear drive device reciprocatingly movable between an embossing position and an inactive position and which at its periphery has a number of elastic pressing members, wherein a heating device for the pressing members is associated with the revolver head.

The configuration of the embossing apparatus according to the invention provides for a rapid supply of heat to the elastic pressing members. A freshly heated elastic pressing member is in a condition of embossing operation at any time so that a correspondingly high cycle speed is achieved. The term 'elastic' is used to denote a pressing member when the surface of the material from which the pressing member is formed is of a hardness in the range of between 45° Shore and 95° Shore, preferably in the range of between 60° Shore and 80° Shore, in particular about 70° Shore.

In that respect the elasticity of the surface of a pressing member is to be matched to the radius of the corner of the surface element, which is to be embossed upon. Thus at the periphery of the revolver head, the elastic pressing members are to be pressed against the surface element in the region of the radius of the corner thereof, in such a way that each pressing member adapts to the radius and thus leads to optimum transfer of the decorative layer on to the corner of the surface element. The smaller the radius is, the correspondingly more elastic is a pressing member accordingly to be.

In the case of the embossing apparatus according to the invention the linear drive device can be formed by a piston-cylinder device.

The pressing members can have at least at their surface silicone rubber, it may be desirable if the pressing members comprise silicone rubber.

The heating device for the elastic pressing members provided on the revolver head is preferably provided at the center of the revolver head. For that purpose the heating device is preferably provided at the axis of the revolver head. Likewise it is possible for the heating device to have heat radiating devices, between which the revolver head is disposed, wherein the heat radiating devices are preferably arranged in a plane oriented perpendicularly relative to the axis of the revolver head.

The revolver head with the associated linear drive device and the heating device are desirably provided on a main frame structure on which an embossing film supply roll, the film advance and direction-changing rollers and the take-up roll are mounted at associated mounting shafts. The mounting shafts for the embossing film supply roll, the film advance and direction-changing rollers and the take-up roll are preferably oriented in parallel relationship with the axis of the revolver head.

Optimum use of the apparatus according to the invention can be effected in that there are provided a number of main frame structures, that corresponds to the number of rounded corners of the respective surface element, wherein the revolver heads are reciprocatingly movable simultaneously between the embossing position and the inactive position.

It is highly productively possible with the embossing apparatus according to the invention to emboss the rounded corners of a surface element, which involve a small radius of for example between 2 and 5 mm, with an embossing film in strip form, wherein the corresponding cycle speeds are adapted to the cycle speeds of the embossing apparatus at which the narrow sides of the surface element are embossed with the embossing film in strip form. Those narrow surfaces can in that respect be of a straight or curved, wavy or any other configuration. The corners of the respective surface element, which are of a small radius, like its narrow sides, can be of a configuration involving a flat surface or a concavely or convexly curved shape.

BRIEF DESCRIPTION OF THE DRAWINGS

Further details, features and advantages will be apparent from the description hereinafter of an embodiment by way of example of the embossing apparatus according to the invention.

DETAILED DESCRIPTION OF THE INVENTION

Figure 1:
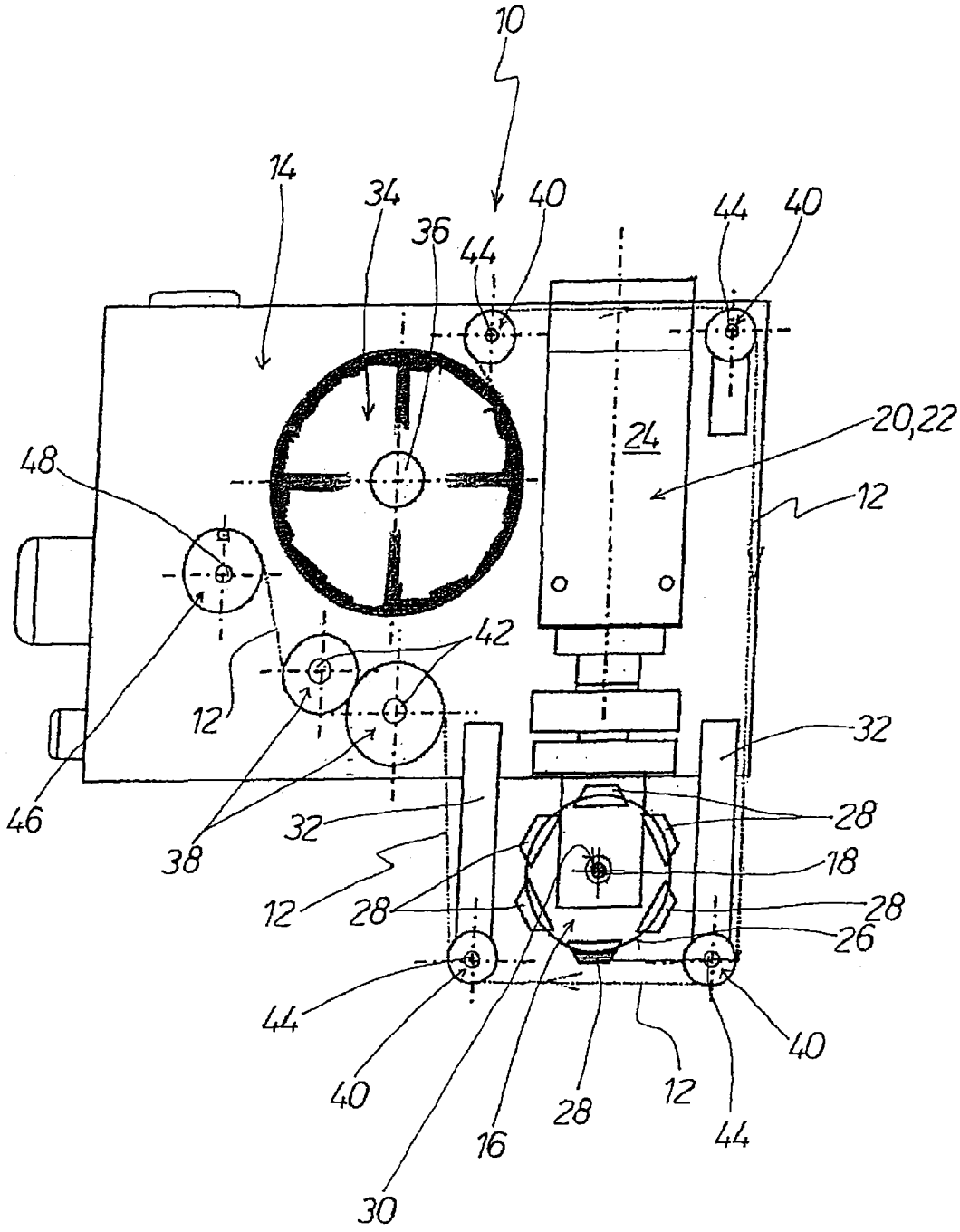
FIG. 1 is a diagrammatical side view of the embossing apparatus of the present invention.

FIG. 1 shows an embodiment of the embossing apparatus 10 which is provided for embossing a decorative layer of an embossing film 12 which is in the form of a strip, on to a small-radiused corner of a surface element (not shown). The embossing apparatus 10 has a main frame structure 14, on which a revolver head 16 is rotatable stepwise about an axis 18. The revolver head 16 is provided at a linear drive device 20. The linear drive device 20 is formed by a piston-cylinder device 22. The cylinder 24 of the piston-cylinder device 22 is fixed to the main frame structure 14. The revolver head 16 is connected to the piston of the piston-cylinder device 22.

The revolver head 16 is reciprocatingly movable between an embossing position and an inactive position by means of the linear drive device 22.

At its periphery 26 the revolver head 16 has a number of elastic punch or pressing members 28. The pressing members 28 comprise silicone rubber and are arranged uniformly spaced at the periphery 26 of the revolver head 16.

Figure 2:
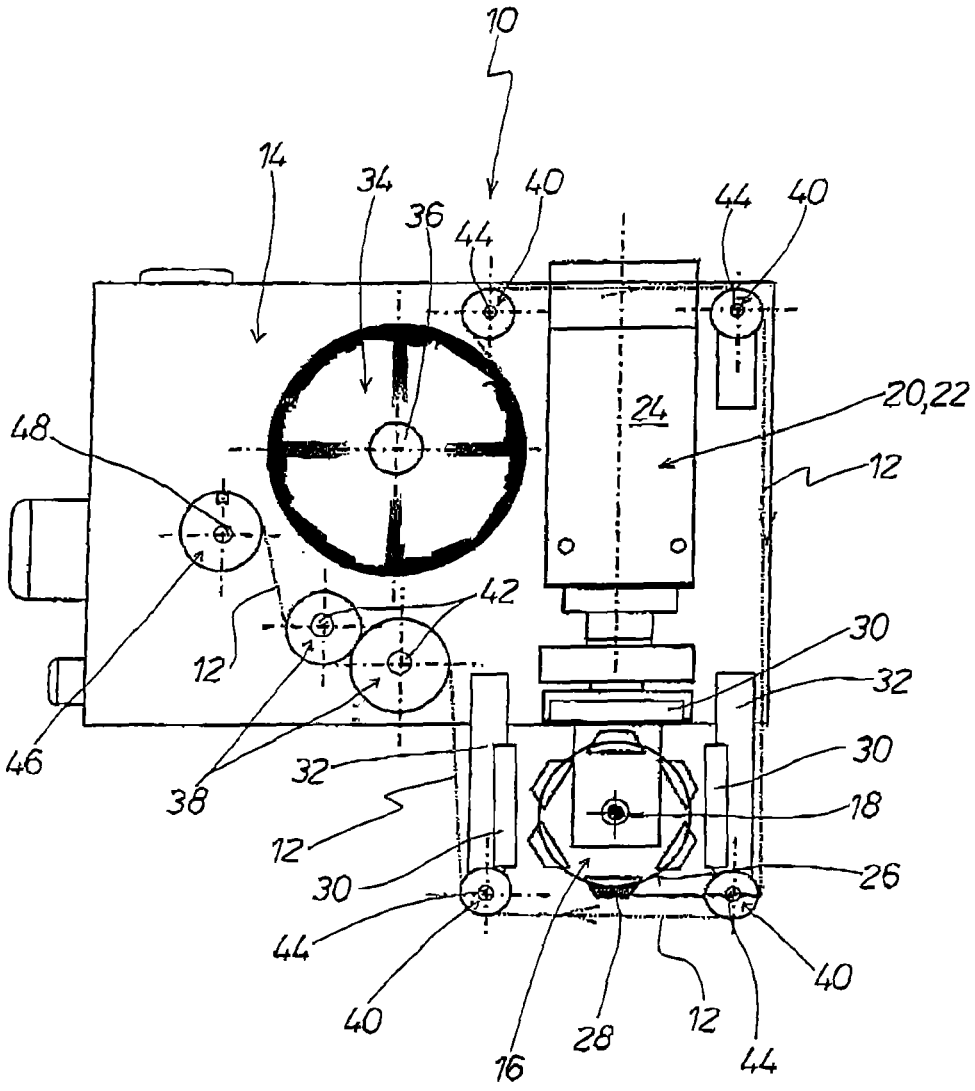
FIG. 2 is a diagrammatical side view of an alternative embodiment of the embossing apparatus of the present invention.

A heating device 30 for the pressing members 28 is associated with the revolver head 16. The heating device 30 is preferably provided in the center of the revolver head 16, as shown in FIG. 1. It is particularly advantageous in that respect if the heating device 30 is provided in the axis 18 of the revolver head. Alternatively, it is possible for the heating device to have heat radiating devices, between which the revolver head is disposed, wherein the heat radiating devices are preferably arranged in a plane oriented perpendicularly relative to the axis of the revolver head, as shown in FIG. 2.

Reference 32 in the Figure denotes film direction-changing roller loops.

An embossing film supply roll 34 is mounted rotatably on a mounting shaft 36 on the main frame structure 14 of the embossing apparatus. Film advance rollers 38 and direction-changing rollers 40 are also rotatably mounted on the main frame structure 14 at associated mounting shafts 42, 44. A take-up roll 46 for the carrier strip of the embossing film 12 is also rotatably mounted on the main frame structure 14 at an associated mounting shaft 48.

Figure 3:
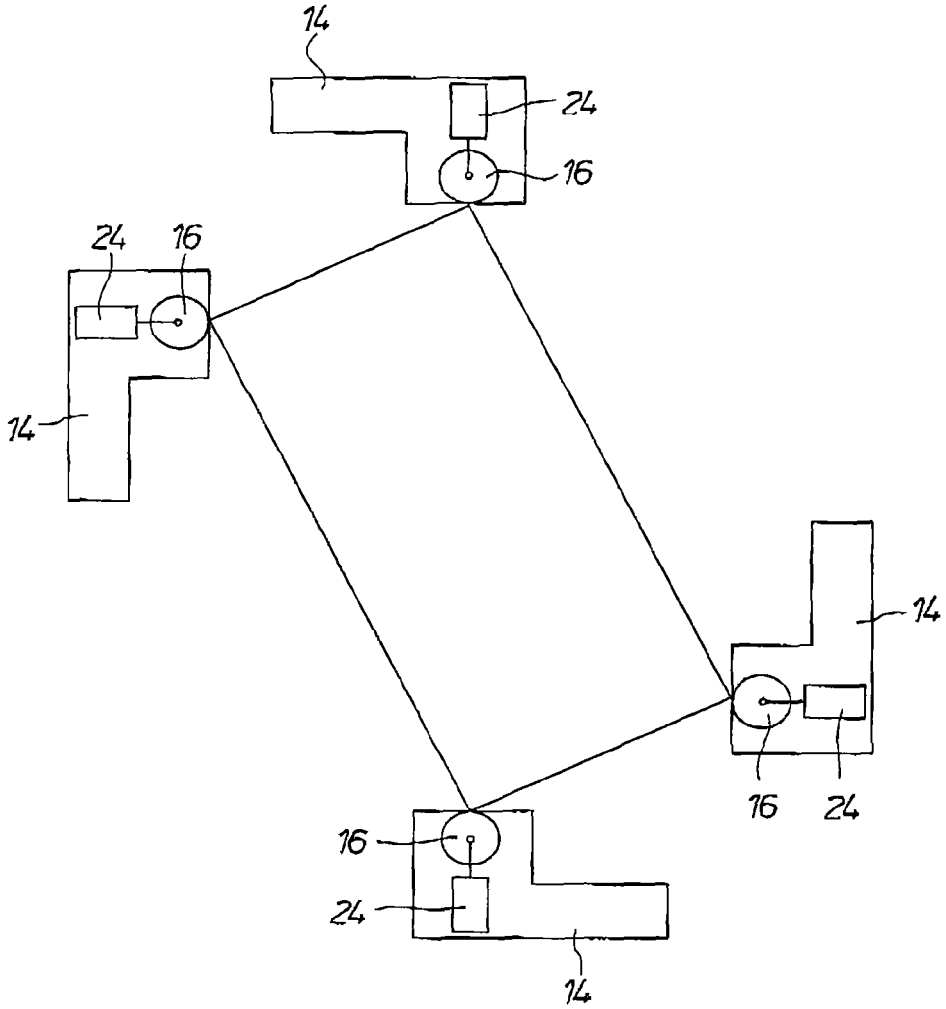
FIG. 3 is a schematic diagram of four embossing apparatus of the present invention.

Optimum use of the apparatus according to the invention can be effected in that there are provided a number of main frame structures, that corresponds to the number of rounded corners of the respective surface element, as shown in FIG. 3, wherein the revolver heads are reciprocatingly movable simultaneously between the embossing position and the inactive position.

The invention claimed is:

1. Apparatus for embossing a decorative layer of an embossing film which is of a strip form, on to a small-radiused corner of a surface element, wherein a revolver head which is rotatable stepwise about an axis and which is provided at a linear drive device reciprocatingly movable between an embossing position and an inactive position and which at its periphery has a number of elastic pressing members, wherein a heating device for the pressing members is associated with the pressing members of the revolver head, said pressing members being adapted to be pressed against the surface element in the region of the radius of the corner thereof whereby said pressing member adapts to the radius, and wherein said pressing member comprises a material having a hardness in the range between 45 and 95 degrees Shore, and wherein said revolver head is rotatable in a stepwise manner such that each pressing member is preheated by said heating device and subsequently provided for pressing the embossing film against the surface element.

2. Apparatus as set forth in claim 1, wherein the linear drive device is formed by a piston-cylinder device.

3. Apparatus as set forth in claim 1, wherein the pressing members have silicone rubber at least at the surface.

4. Apparatus as set forth in claim 1, wherein the pressing members comprise silicone rubber.

5. Apparatus as set forth in claim 1, wherein the heating device is provided at the center of the revolver head.

6. Apparatus as set forth in claim 5, wherein the heating device is provided in the axis of the revolver head.

7. Apparatus as set forth in claim 1, wherein the heating device has heating radiating devices between which the revolver head is provided.

8. Apparatus as set forth in claim 1, wherein the revolver head with the associated linear drive device and the heating device are provided on a main frame structure on which an embossing film supply roll, film advance and direction-changing rollers and take-up roll are mounted at associated mounting shafts.

9. Apparatus as set forth in claim 8, wherein the mounting shafts for the embossing film supply roll, the film advance and direction-changing rollers and the take-up roll are oriented parallel in relation to the axis of the revolver head.

10. Apparatus as set forth in claim 8, wherein there are provided a number of main frame structures, that corresponds to the number of corners of the respective surface element to be embossed upon, wherein the revolver heads are reciprocatingly movable simultaneously between the embossing position and the inactive position.

11. Apparatus as set forth in claim 1, wherein said pressing members are adapted to be pressed against the corner of a surface element having a radius between 2 and 5 mm.

12. Apparatus as set forth in claim 1, wherein said pressing member comprises a material having a hardness in the range between 60 and 80 degrees Shore.

13. Apparatus as set forth in claim 12, wherein said pressing member comprises a material having a hardness of about 70 degrees Shore.

14. Apparatus as set forth in claim 1, wherein said pressing members have a surface with an elasticity matched to the radius of the corner of the surface element to which it is pressed against, whereby the elasticity increases as the radius decreases.

15. Apparatus as set forth in claim 1, wherein said pressing members are adapted to be pressed against the corner of a surface element having a flat surface, a concavely curved shape or a convexly curved shape.

16. Apparatus as set forth in claim 1, wherein said pressing members are arranged in a spaced relationship around the periphery of said revolver head.

17. Apparatus as set forth in claim 16, wherein said pressing members are uniformly spaced around the periphery of said revolver head.

18. Apparatus as set forth in claim 1, wherein the apparatus has a cycle speed adapted to an embossing cycle speed of the surface element.

19. Apparatus as set forth in claim 1, wherein said pressing members are in the form of punch members.

20. An apparatus for embossing a decorative layer of an embossing film on to a small-radiused corner of a surface element, the apparatus comprising:

a linear drive device including a movable piston;

a revolver head attached to said movable piston, said revolver head being reciprocatingly movable together with said piston between an embossing position and an inactive position, said revolver head being further rotatable in a stepwise manner about an axis;

a plurality of elastic punch members provided on a periphery of said revolver head, said punch members comprising a material having a hardness in the range between 45 and 95 degrees Shore such that said punch members are adapted to be pressed against the surface element in the region of the radius of the corner thereof whereby said punch member adapts to the radius; and a heating device for heating the punch members of the revolver head, wherein said revolver head is rotatable in a stepwise manner such that each punch member is preheated by said heating device and subsequently provided for pressing the embossing film against the surface element.

* * * * *